United States Patent [19]

Aono et al.

[11] Patent Number: 4,704,344

[45] Date of Patent: Nov. 3, 1987

[54] HEAT DEVELOPABLE LIGHT-SENSITIVE MATERIAL WITH PROTECTIVE LAYER

[75] Inventors: Toshiaki Aono; Koichi Nakamura, both of Kanagawa, Japan

[73] Assignee: Fuji Photo Film Co., Ltd., Kanagawa, Japan

[21] Appl. No.: 890,973

[22] Filed: Jul. 29, 1986

Related U.S. Application Data

[63] Continuation of Ser. No. 678,428, Dec. 5, 1984, abandoned.

[30] Foreign Application Priority Data

Dec. 5, 1983 [JP] Japan ..... 58-228309

[51] Int. Cl.[4] ..... G03C 5/54; G03C 7/00

[52] U.S. Cl. ..... 430/203; 430/215; 430/523; 430/531; 430/536; 430/539; 430/617; 430/619; 430/961

[58] Field of Search ..... 430/203, 215, 262, 263, 430/351, 523, 531, 536, 539, 617, 619, 961

[56] References Cited

U.S. PATENT DOCUMENTS

| | | | |
|---|---|---|---|
| 3,856,527 | 12/1974 | Hamb et al. | 430/961 |
| 3,893,860 | 7/1975 | Sutton et al. | 430/353 |
| 4,430,415 | 2/1984 | Aono et al. | 430/203 |
| 4,500,626 | 2/1985 | Naito et al. | 430/203 |
| 4,584,267 | 4/1986 | Masukawa et al. | 430/203 |
| 4,619,883 | 10/1986 | Aono et al. | 430/203 |
| 4,628,021 | 12/1986 | Sawada et al. | 430/203 |

FOREIGN PATENT DOCUMENTS

| | | | |
|---|---|---|---|
| 1590957 | 6/1981 | United Kingdom | 430/203 |

OTHER PUBLICATIONS

"Photothermographic Silver Halide Systems", Carpenter et al, *Research Disclosure* No. 17029, 6/1978, pp. 9–15.

*Primary Examiner*—Richard L. Schilling

*Attorney, Agent, or Firm*—Sughrue, Mion, Zinn, Macpeak & Seas

[57] ABSTRACT

A heat developable light-sensitive material is disclosed which is provided with a protective layer comprising, as a major constituent, a nonionic, hydrophilic polymer. On heat developing the light-sensitive material, a mobile dye image is formed which can be transferred to a dye fixing material superposed on the light-sensitive material. After the transfer of the dye image, the light-sensitive material can be readily separated from the dye fixing material due to the presence of the protective layer, and thus a sharp image can be formed in the dye fixing material.

10 Claims, No Drawings

HEAT DEVELOPABLE LIGHT-SENSITIVE MATERIAL WITH PROTECTIVE LAYER

This is a continuation of application Ser. No. 678,428, filed Dec. 5, 1984, now abandoned.

FIELD OF THE INVENTION

The present invention relates to a heat developable light-sensitive material. More particularly, it is concerned with a heat developable light-sensitive material which permits efficient transfer of a dye image form in the heat developable light-sensitive material to a dye fixing material without deterioration of the quality of the dye image.

BACKGROUND OF THE INVENTION

Photography using silver halide is superior in photographic characteristics such as sensitivity and control of gradation to other photographic processes such as electro-photography and diazo photography and thus has been widely used. Another technique has recently been developed in which the image forming processing of light-sensitive materials using silver halide is carried out by a dry process such as by heating in place of the conventional wet process using developers, for example, so that the desired image can be obtained in a simplified manner and rapidly. In this technique, heat developable light-sensitive materials using silver halide are used.

These heat developable light-sensitive materials are known and details thereon are given in, for example, *Shashin Kogaku no Kiso,* Corona Co., pages 553–555 (1979), *Eizo Johoh,* page 40, April (1978), and *Nebletts Handbook of Photography and Reprography,* 7th ed., Van Nostrand Reinhold Co., pages 32–33.

In conventional procedures, however, reduced silver images and color images are simultaneously formed in exposed areas after heat development and, therefore, the color images are turbid, cannot be stored for long periods of time, and are gradually colored during storage. That is, the conventional procedures fail to provide images which are sharp and satisfactory for practical use.

In order to overcome the above problems, a light-sensitive material and a method of forming images using the light-sensitive material have been proposed in Japanese Patent Application (OPI) Nos. 149046/83 and 168439/84 (the term "OPI" as used herein means a "published unexamined Japanese patent application"). In these methods, mobile dyes formed imagewise are transferred to a dye fixing layer. For this dye transfer, solvents such as water, basic aqueous solutions, alcohols, and dimethylacetamide are supplied, or, alternatively, hydrohilic thermal solvents are previously incorporated in the materials, whereby independent application of a solvent(s) from the outside can be omitted. In respect of convenience, the latter is advantageous over the former.

In the above image forming method, dye-releasing activator such as bases, for example, are conveniently used so that color images of high density can be rapidly formed.

One embodiment of an image forming method is such that a dry fixing material comprising a support having provided thereon a dye fixing layer is separately prepared from a light-sensitive material and a dye image is fixed in the dye fixing material. In this case, it is necessary for the dye fixing material and the light-sensitive material to be brought into close contact to such an extent that the transfer of the mobile dye can be sufficiently achieved and, furthermore, it is required that, after the transfer of the dye image is completed, the dye fixing material and the light-sensitive material can be readily separated apart without causing any damage to the two materials. In conventional heat developable light-sensitive materials, however, difficulties are sometimes encountered in the above separation process and thus they have been desired to be improved in this respect. Particularly, in the case that there is employed a dry dye fixing step where a light-sensitive material and a dye fixing material are superposed and heated in a substantially water-free condition, the above problem is liable to occur and a good dye image cannot be obtained because an emulsion of the light-sensitive material sticks to the dye fixing material.

SUMMARY OF THE INVENTION

An object of the present invention is to provide a heat developable light-sensitive material which can be readily separated from a dye fixing material after images transfer and which prevents image deterioration.

Another object of the present invention is to provide an image forming method whereby a good image can be formed even in the case where all steps from imagewise exposure to fixing of the dye image are carried out in a dry condition.

It has been found that these objects are attained by providing a protective layer comprising a nonionic, hydrophilic polymer or polymers.

The present invention relates to a heat developable light-sensitive material capable of imagewise forming a mobile dye upon heating, wherein a protective layer comprises a nonionic, hydrophilic polymer.

DETAILED DESCRIPTION OF THE INVENTION

Although the reason why the heat developable light-sensitive material of the present invention provided with a protective layer made mainly of a nonionic, hydrophilic polymer is superior in separation capability from a dye fixing material is not yet clear, it is believed to be as follows.

A dye fixing layer of a dye fixing material usually contains one or more mordants to fix a dye(s). In general, as these mordants, polymers having cationic sites are used. The specific examples of the polymers will be shown hereafter. Therefore, if a light-sensitive material contains polyanions, when the light-sensitive and dye fixing materials are brought into close contact with each other in order to transfer dye (formed in the light-sensitive material by heat development) to the dye fixing material, adhesion develops between the two materials as a result of the electrostatic action between the cationic sites and polyanions and thus the two materials are difficult to separate from each other. This difficulty involved in the separation of the two materials is enhanced by the fact that in the production of light-sensitive materials, thickener are usually necessarily added for the purpose of preventing uneven coating by a coater and, as these thickener, polyanions having, for example, the recurring unit represented by the following formula:

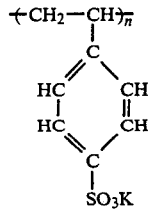

are used.

The above adhesion problem markedly occurs particularly when the conventional polymer mordants having cationic sites are present in the uppermost layer of the dye fixing material. On the other hand, the incorporation of nonionic, hydrophilic polymers in a light-sensitive material as per the present invention enables one to weaken the above described action between cationic sites and polyanions. The above effect is marked when the nonionic, hydrophilic polymers are present in the uppermost layer or protective layer of the light-sensitive material.

Nonionic, hydrophilic polymers which can be used in the present invention are illustrated below.

A molecular weight range of the nonionic, hydrophilic polymers is 2,000 to 1,000,000 and is preferably 5,000 to 400,000.

(1) Polymers having the following general formula (I):

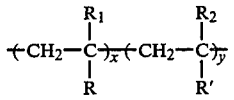

(I)

where:

x=0 to 100 mol%, y=0 to 100 mol%, x+y=100 mol%

$R_1$, $R_2$=hydrogen or alkyl (e.g., $CH_3$), and

R, R'=—OH, carbamoyl (e.g., —$CONH_2$ or —$CONHCH_3$), a 5- or 6-membered nitrogen-containing heterocyclic group, e.g.,

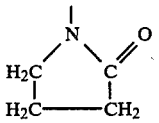

or —$CONH(CH_2)_nNH_2$ (n=0 to 3).

Representative examples of polymers of general formula (I) are shown below.

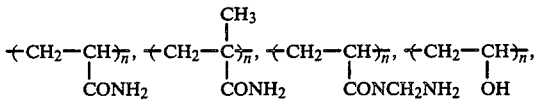

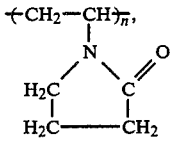

(2) Polyethylene oxides having a molecular weight range of 10,000 to 400,000

(3) Natural products and their derivatives

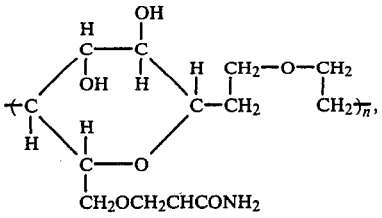

dextran, graft polymers of dextrin and ethylene oxide, graft polymers of dextrin and propylene oxide, poly(N-vinyl)pyrrolidone, grafted gelatin, hydroxyethyl cellulose, hydroxypropylmethyl cellulose phthalate,

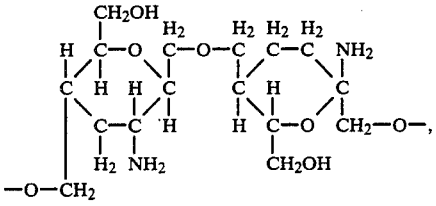

starch, and pullulan.

The protective layer of the light-sensitive material of the present invention is made up mainly of nonionic, hydrophilic polymers as described above, and it is preferred that the amount of polyanions conventionally used is small, concretely, not more than 10%. When, therefore, these nonionic, hydrophilic polymers function as thickeners, it is possible that polyanions not be substantially used. This is a preferred embodiment of the present invention.

In the present invention, the coating amount of the nonionic, hydrophilic polymers employed in the protective layer is 0.01 to 5 g/$m^2$, and preferably 0.1 to 2 g/$m^2$.

In the heat developable light-sensitive material of the present invention, dye providing substances as described below can be used in a suitable conventional manner.

That is, any heat developable light-sensitive materials and processes as described in U.S. Pat. Nos. 3,152,904, 3,301,678, 3,392,020, 3,457,075, British Pat. Nos. 1,131,108, 1,167,777 and *Research Disclosure,* RD-17029, pages 9–15, June 1978 can be used in the present invention.

With respect to processes for obtaining dye images (color images), there have been many of such proposed. With respect to processes for forming dye images by combining an oxidation product of a developing agent with couplers, it has been proposed to use p-phenylenediamine reducing agents and phenolic or active methylene couplers in U.S. Pat. No. 3,531,286, p-aminophenol type reducing agents in U.S. Pat. No. 3,761,270, sulfonamidophenol type reducing agents in Belgium Patent No. 802,519 and *Research Disclosure,* September 1975, pages 31 and 32, and combinations of sulfonamidophenol type reducing agents and 4-equivalent type couplers in U.S. Pat. No. 4,021,240.

As couplers used in the above image formation process, there are those described in the above cited patents. Further, color couplers used in liquid development processing hitherto known can be used. These couplers are compounds capable of coloring by oxidative coupling with, for example, aromatic primary amine developing agents (for example, phenylenediamine derivatives or aminophenol derivatives, etc.). Typical examples are summarized as follows. For example, as magenta couplers, there are 5-pyrazolone couplers, pyrazolobenzimidazole couplers, cyanoacetylcoumarone couplers and opened chain acylacetonitrile couplers. As yellow couplers, there are acylacetamide couplers (for example, benzoylacetanilides and pivaloylacetanilides), etc. As cyan couplers, there are naphthol couplers and phenol couplers, etc. It is preferred that these couplers be nondiffusible and have a hydrophobic group called a ballast group in the molecule thereof or be polymerized. The couplers may be 4-equivalent or 2-equivalent to silver ions. Further, they may be colored couplers having a color correction effect or couplers which release a development restrainer upon development (DIR couplers).

A process for forming images in which mobile dyes are released by utilizing the coupling reaction of a reducing agent oxidized by an oxidation-reduction reaction with silver halide or an organic silver salt at high temperature has been described in European Pat. No. 79,056, West German Pat. No. 3,217,853 and European Pat. No. 67,455.

Further, a process in which a nitrogen-containing heterocyclic group is introduced into a dye and a silver salt is formed to release dye by heat development has been described in *Research Disclosure,* May 1978, pages 54–58, RD-16966.

In addition, a process for forming positive color images by an exposed silver dye bleaching process has been described in, for example, *Research Disclosure,* April 1976, pages 30–32 (RD-14433) and December 1976, pages 14–15 (RD-15227) and U.S. Pat. No. 4,235,957, etc. where useful dyes and bleaching procedures are described.

Further, a process for forming color images utilizing leuco dyes has been described in, for example, U.S. Pat. Nos. 3,985,565 and 4,022,617.

Moreover, in recent years, various new materials and processes for forming color images by heat development have been proposed, and these materials are particularly suitably used in the present invention. A process using dye providing substances which release a mobile dye as a result of oxidation-reduction reactions with silver halide or an organic silver salt at high temperature has been described in European Pat. No. 76,492, West German Pat. No. 3,215,485, European Pat. No. 66,282 and Japanese Patent Application (OPI) Nos. 65839/84 and 152440/84.

As dye providing substances used in the above described processes, there are the following.

Dye providing substances useful in the present invention are represented by the following formula (II)

$$D—Y \qquad (II)$$

wherein D represents a dye moiety or a precursor thereof, and Y represents a substrate having the function of changing the diffusibility of the dye providing substance (II) by an oxidation-reduction reaction in the heat development process. The term "changing diffusibility" means: (1) compound (II) which is essentially nondiffusible changes into a diffusible compound or releases a diffusible dye; or (2) compound (II) which is essentially diffusible changes into a nondiffusible compound. Further, depending upon the properties of Y, this change can be caused by oxidation of Y or by reduction thereof; both procedures can be suitably used.

As examples of changing diffusibility by oxidation of Y, it is possible to use the dye releasing redox substrates such as p-sulfonamidonaphthols (including p-sulfonamidophenols, as described in Japanese Patent Application (OPI) Nos. 33826/73 and 50736/78 and European Pat. No. 76,492), o-sulfonamidophenols (including o-sulfonamidophenols, as described in Japanese Patent Application (OPI) Nos. 113624/76, 12642/81, 16130/81, 16131/81, 4043/82 and 650/82, U.S. Pat. No. 4,053,312 and European Pat. No. 76,492), hydroxysulfonamide hetero ring compounds (as described in Japanese Patent Application (OPI) No. 104343/76 and European Pat. No. 76,492), 3-sulfonamidoindoles (as described in Japanese Patent Application (OPI) Nos. 104343/76, 46730/78, 130122/79 and 85055/82 and European Pat. No. 76,492) or α-sulfonamidoketones (as described in Japanese Patent Application (OPI) Nos. 3819/78 and 48534/79 and European Pat. No. 76,492), etc.

As other examples, dyes can be released by intramolecular nucleophilic attack after oxidation of Y, i.e., one can use the intramolecular assist type substrates described in Japanese Patent Application (OPI) Nos. 20735/82 and 65839/84.

As other examples, there are substrates which release a dye by an intramolecular ring-closure reaction under basic conditions but do not substantially cause release of the dye when Y is oxidized (as described in Japanese Patent Application (OPI) No. 63618/76). As a modification, substrates which release a dye by recyclization of an isoxazolone ring by a nucleophilic agent (as described in Japanese Patent Application (OPI) Nos. 111628/74 and 4819/77) can be used.

Further, as other examples, there are substrates which release a dye moiety by dissociation of an acid proton under basic conditions but do not substantially release the dye when Y is oxidized (as described in Japanese Patent Application (OPI) Nos. 69033/78 and 130927/79).

On the other hand, as examples of changing diffusibility by reduction of Y, there are nitro compounds as described in Japanese Patent Application (OPI) No. 110827/78 and quinone compounds as described in Japanese Patent Application (OPI) No. 110827/78 and U.S. Pat. Nos. 4,356,249 and 4,358,525. There are compounds which are reduced by a reducing agent (called an electron donor) in the heat development process without consuming the same and release a dye by molecular attack of the nucleophilic group formed as a result of the reduction. As a modification, quinone type substrates wherein the dye moiety is released by dissociation of an acid proton of the reduced material are useful (as described in Japanese Patent Application (OPI) Nos. 130927/79 and 164342/81). In the case of using the above described substrates where diffusibility changes by reduction, it is essential to use a suitable reducing agent (electron donor) through which a silver salt oxidizing agent and a dye providing substance can react, and examples thereof are described in the above-mentioned references. Further, such substrates that an electron donor coexists in the substrate Y (called an LDA compound) are also useful.

Further, as other image forming materials, materials where the mobility of the compound having a dye part changes as a result of an oxidation-reduction reaction with silver halide or an organic silver salt at high temperature can be used, as described in Japanese Patent Application (OPI) No. 165054/84.

In addition, materials which release a mobile dye by a reaction with silver ion in the light-sensitive material as are described in Japanese Patent Application (OPI) No. 180548/84 can be used.

Many of the above described materials are materials wherein an imagewise distribution of mobile dyes corresponding to exposure is formed in the light-sensitive material by heat development, and processes of obtaining visible images by transferring the dyes of the image to a dye fixing material (diffusion transfer) have been described in the above described cited patents and Japanese Patent Application (OPI) Nos. 168439/84 and 182447/84, etc.

When the heat developable light-sensitive material used in this invention is heat developed in a substantially water-free condition after or simultaneously with imagewise exposure, a mobile hydrophilic dye image is obtained simultaneously with the formation of a silver image either in exposed areas or in unexposed areas with exposed light-sensitive silver halide acting as a catalyst. In the as-heat developed state, the formed or released mobile hydrophilic dye image is difficult to distinguish because unreacted image forming substance, silver halide, developed silver, etc. are present. Further, the storage stability of the developed photograhic material is extremely poor. In the present invention, however, the dye of the resulting dye image is a hydrophilic mobile dye, and, therefore, the hydrophilic dye can move to a dye fixing layer in an environment for which the hydrophilic dye has affinity. Consequently, there can be obtained a dye image having excellent quality and storage stability. This step is the step of "dye fixing" in this invention.

The dye fixing step can be carried out by supplying a solvent (see Japanese Patent Application (OPI) Nos. 58543/83, 79247/83 and 149046/83). Further, by creating an environment having an affinity for the hydrophilic dye by the inclusion of a hydrophilic thermal solvent, a dye image providing good color reproduction can be formed without particularly supplying a solvent, and, therefore, by a completely dry treatment which does not at all require supplying solvent in the entire process from exposure, heat development to dye fixing (see Japanese Patent Application (OPI) No. 181351/84).

The theory of this process is essentially the same for a light-sensitive material comprising a negative emulsion and a light-sensitive material comprising a direct positive emulsion and only differs in that the portion to be developed is an exposed area in one and an unexposed area in the other. Accordingly, even when a direct positive emulsion is used, a dye image providing good color reproducibility is obtained in the same way as in the case of a negative emulsion.

Heating in a substantially water-free condition, as used herein, means heating at a temperature of 80° to 250° C. The term "substantially water-free condition" means that the reaction system is in equilibrium with water in the air, and water for inducing or promoting the reaction is not particularly or positively supplied from exterior the element. Such a condition is described at page 374 of "The Theory of the Photographic Process", 4th edition (T. H. James, published by Macmillan Co.).

The dye providing substance used in the present invention can be introduced into a layer of the light-sensitive material by known methods such as a method as described in U.S. Pat. No. 2,322,027. In this case, an organic solvent having a high boiling point or an organic solvent having a low boiling point as described below can be used. For example, the dye providing substance is dispersed in a hydrophilic colloid after dissolution in an organic solvent having a high boiling point, for example, a phthalic acid alkyl ester (for example, dibutyl phthalate, dioctyl phthalate, etc.), a phosphoric acid ester (for example, diphenyl phosphate, triphenyl phosphate, tricresyl phosphate, dioctylbutyl phosphate, etc.), a citric acid ester (for example, tributyl acetylcitrate, etc.), a benzoic acid ester (for example, octyl benzoate, etc.), an alkylamide (for example, diethyl laurylamide, etc.), an aliphatic acid ester (for example, dibutoxyethyl succinate, dioctyl azelate, etc.), a trimesic acid ester (for example, tributyl trimesate, etc.), etc., or an organic solvent having a boiling point of about 30° C. to 160° C., for example, a lower alkyl acetate such as ethyl acetate, butyl acetate, etc., ethyl propionate, secondary butyl alcohol, methyl isobutyl ketone, $\beta$-ethoxyethyl acetate, methyl cellosolve acetate, cyclohexanone, etc. The above described organic solvents having a high boiling point and organic solvents having a low boiling point may be used as a mixture thereof, if desired.

Further, it is possible to use a dispersion method using a polymer as described in Japanese Patent Publication No. 39853/76 and Japanese Patent Application (OPI) No. 59943/76. Moreover, various surface active agents can be used when the dye providing substance is dispersed in a hydrophilic collbid. For this purpose, the surface active agents illustrated in other parts of the specification can be used.

The amount of the organic solvent having a high boiling point used in the present invention is 10 g per g of the dye providing substance used or less, and is preferably 5 g per g or less.

The amount of the organic solvent having a high boiling point used in the present invention is 1 ml or less per g of gelatin, preferably 0.5 ml or less per g of gelatin, and more preferably 0.3 ml or less per g of gelatin.

The silver halide used in the present invention is not limited and includes silver chloride, silver chlorobromide, silver chloroiodide, silver bromide, silver iodobromide, silver chloroiodobromide, silver iodide, etc.

In the embodiment of the present invention in which the organic silver salt oxidizing agent is not used, rather, the silver halide is used alone, a particularly preferred silver halide is a silver halide at least partially containing silver iodide crystal in its particle. Such, a silver halide shows the X-ray diffraction pattern of pure silver iodide.

The silver halide used in the present invention may be used as is. However, it may be chemically sensitized with a chemical sensitizing agent such as compounds of sulfur, selenium or tellurium, etc., or compounds of gold, platinum, palladium, rhodium or iridium, etc., a reducing agent such as tin halide, etc., or a combination thereof. Details thereon are described in T. H. James, *The Theory of the Photographic Process, Fourth Edition, Chapter* 5, pages 149 to 169.

In a particularly preferred embodiment of the present invention, an organic silver salt oxidizing agent is used. The silver halide used in this case need not always necessarily have the characteristic that the silver halide shows the X-ray diffraction pattern of pure silver iodide crystal as in the case of using silver halide alone. Any silver halide which is known in the art can be used.

As desired or necessary, a reducing agent can be used in this invention. Useful reducing agents are color developing agents which form images by oxidative coupling. As reducing agents used in heat developable color photographic materials, U.S. Pat. No. 3,531,286 describes p-phenylene-type color developing agents typified by N,N-diethyl-3-methyl-p-phenylenediamine. Other useful reducing agents are aminophenols as described in U.S. Pat. No. 3,761,270.

In the present invention, a thermal solvent can be used to improve this problem as a one mean. The term "thermal solvent" means a non-hydrolyzable organic material which is solid at ambient temperature but which melts together with other necessary components of the heat developable light-sensitive material at the temperature of heat development or below. When heat development is carried out in the presence of a thermal solvent, the developing speed is accelerated and the image quality is improved.

Preferred examples of thermal solvents include compounds which can act as a solvent for the developing agent and compounds having a high dielectric constant which accelerate physical development of silver salts. Examples of preferred thermal solvents include polyglycols as described in U.S. Pat. No. 3,347,675, for example, polyethylene glycol having an average molecular weight of 1,500 to 20,000, derivatives of polyethylene oxide such as polyethylene oxide oleic acid ester, etc., beeswax, monostearin, compounds having a high dielectric constant which have an —$SO_2$— or —CO— group such as acetamide, succinimide, ethylcarbamate, urea, methylsulfonamide or ethylene carbonate, polar substances as described in U.S. Pat. No. 3,667,959, lactone of 4-hydroxybutanoic acid, methylsulfinylmethane, tetrahydrothiophene-1,1-dioxide, and 1,10-decanediol, methyl anisate and biphenyl suberate as described in *Research Disclosure,* pages 26 to 28 (December, 1976), etc.

The role of the thermal solvent in this invention is not always clear, but its main role is understood as facilitating the diffusion of reactive molecular species during development.

The light-sensitive silver halide and the organic silver salt oxidizing agent used in the present invention are added to the binder as described below. Further, the dye releasing redox compound is dispersed in the binder described below.

The binder(s) which can be used in the present invention can be employed individually or as a combination thereof. A hydrophilic binder can be used as the binder according to the present invention. A typical hydrophilic binder is a transparent or translucent hydrophilic colloid, examples of which include a natural substance, for example, a protein such as gelatin, a gelatin derivative, a cellulose derivative, etc., a polysaccharide such as starch, gum arabic, pullulan, dextrin, etc., and a synthetic polymer, for example, a water-soluble polyvinyl compound such as polyvinyl alcohol, polyvinyl pyrrolidone, acrylamide polymer, etc. Another example of a synthetic polymer compound is a dispersed vinyl compound in latex form which is used for the purpose of increasing dimensional stability of a photographic material.

The coating amount of the binder used in the present invention is 20 g or less per $m^2$, preferably 10 g or less per $m^2$, and more preferably 7 g or less per $m^2$.

The silver halide used in the present invention can be spectrally sensitized with methine dyes or other dyes. Suitable dyes which can be employed include cyanine dyes, merocyanine dyes, complex cyanine dyes, complex merocyanine dyes, holopolar cyanine dyes, hemicyanine dyes, styryl dyes, and hemioxonol dyes. Of these dyes, cyanine dyes, merocyanine dyes and complex merocyanine dyes are particularly useful.

In the present invention, various dye releasing activators can be used by various means, for example, by including them into any layer of the photographic material or any layer of the dye fixing material. The term "dye releasing activators" denotes compounds which promote the oxidation-reduction reaction of the light-sensitive silver halide and/or organic silver salt oxidizing salt agent with the dye providing substance. When a dye providing substance which is particularly illustrated in a general formula (II) is used in the photographic material, the dye releasing activator nucleophilically acts on the dye providing substance which has been oxidized by the dye releasing reaction which takes place subsequent to the oxidation-reduction reaction, and thus promotes the dye releasing of the dye providing substance. Bases or base precursors may be used as such dye releasing activators. In the present invention, the use of such dye releasing activators is especially advantageous to promote the reaction. The base precursors are especially preferred because they can prevent changes of the light-sensitive material during storage. The base precursors, as used herein, release a basic component upon heating at development. The basic component released may be an inorganic or organic base as described below.

As the base precursors, substances which undergo reaction upon heating to release a base, such as salts of an organic acid which is decarboxylated by heating to decompose and form a base, or compounds which are decomposed by Lossen rearrangement or Beckman rearrangement to release an amine, are used.

As preferred base precursors, there are the precursors of the above bases. For example, there are salts of thermally decomposable organic acids such as trichloroacetic acid, propionic acid, cyanoacetic acid, sulfonylacetic acid or acetoacetic acid, etc., and salts of 2-carboxycarboxamide as described in U.S. Pat. No. 4,088,496, etc.

Preferred examples of the base precursors are described. As examples of compounds which are believed to release a base by decarboxylation of the acid portion thereof, there are the following.

As trichloroacetic acid derivatives, there are guanidine trichloroacetic acid, piperidine trichloroacetic acid, morpholine trichloroacetic acid, p-toluidine trichloroacetic acid, 2-picoline trichloroacetic acid, etc.

In addition, the base precursors described in British Pat. No. 998,945, U.S. Pat. No. 3,220,846 and Japanese Patent Application (OPI) No. 22625/75, etc., can be used.

As substances in addition to trichloroacetic acids, there are the 2-carboxycarboxamide derivatives described in U.S. Pat. No. 4,088,496, $\alpha$-sulfonylacetate derivatives as described in U.S. Pat. No. 4,060,420 and salts of propionic acid derivatives and bases as described in Japanese Patent Application (OPI) No.

180537/84, etc. Salts using an alkali metal or an alkaline earth metal as a base component in addition to organic bases are also useful and are described in Japanese Patent Application No. 69597/83.

As other precursors, hydroxamic carbamates as described in Japanese Patent Application (OPI) No. 168440/84 utilizing Lossen rearrangement and aldoxime carbamates described in Japanese Patent Application No. 31614/83 which form a nitrile, etc., are also useful.

Further, amineimides as described in *Research Disclosure,* No. 15776, May 1977 and aldonic amides as described in Japanese Patent Application (OPI) No. 22625/75 are suitably used, because they form a base by decomposition at high temperature.

The releasing of a basic component by the aforesaid base precursors upon heating can be checked by various methods. For example, analytical means such as gas chromatography or liquid chromatography may be used. It is also possible to use a method which comprises heating the light-sensitive material, then applying a small amount of water to it, and measuring the pH of the film surface.

It is advantageous to use a compound represented by the following general formula (III) in the heat developable light-sensitive material in order to accelerate development and accelerate release of a dye.

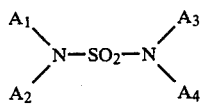

(III)

wherein $A_1$, $A_2$, $A_3$ and $A_4$, which may be the same or different, each represents a hydrogen atom or a substituent selected from an alkyl group, a substituted alkyl group, a cycloalkyl group, an aralkyl group, an aryl group, a substituted aryl group and a heterocyclic group; and $A_1$ and $A_2$ or $A_3$ and $A_4$ may combine with each other to form a ring.

Specific examples of such compounds include $H_2NSO_2NH_2$, $H_2NSO_2N(CH_3)_2$, $H_2NSO_2N(C_2H_5)_2$, $H_2NSO_2NHCH_3$, $H_2NSO_2N(C_2H_4OH)_2$, $CH_3NHSO_2NHCH_3$,

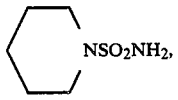

etc.

The above described compound can be used in a broad range e.g., up to 20% by weight based on the amount of a dry coated layer of the light-sensitive material. A range of 0.1% by weight to 15% by weight is more preferred.

It is advantageous to use a water releasing compound in the present invention in order to accelerate the dye forming reaction.

The term "water releasing compound" means a compound which releases water by decomposition during heat development. These compounds are particularly known in the field of printing of fabrics, and $NH_4Fe(SO_4)_2.12H_2O$, etc., as described in Japanese Patent Application (OPI) No. 88386/75 are useful.

The support used for the light-sensitive material in the present invention is one which has good dimensional stability at the processing temperature. As supports, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or another plastic material may be used. The polyesters described in U.S. Pat. Nos. 3,634,089 and 3,725,070 are preferably used. More preferably, a polyethylene terephthalate film is used.

The coating solution used in this invention may be prepared by separately forming a silver halide and an organic silver salt oxidizing agent, and mixing them prior to use. But it is also effective to mix the two in a ball mill for a long period of time. Another effective method comprises adding a halogen-containing compound to the prepared organic silver salt oxidizing agent, and forming silver halide by the reaction of the halogen-containing compound with silver in the organic silver salt oxidizing agent.

Methods of preparing the silver halide and organic silver salt oxidizing agents and manners of blending them are described in *Research Disclosure,* No. 17029, Japanese Patent Application (OPI) Nos. 32928/75 and 42529/76, U.S. Pat. No. 3,700,458, and Japanese Patent Application (OPI) Nos. 13224/74 and 17216/75.

A suitable coating amount of the light-sensitive silver halide and the organic silver salt ozidizing agent employed in the present invention can vary widely but is generally a total of from 50 mg/m$^2$ to 10 g/m$^2$, calculated as an amount of silver.

The photographic emulsion layer and other hydrophilic colloid layers which are used in the light-sensitive material of the present invention may contain surface active agents for various purposes, for example, as coating aids or for prevention of electrical charging, improvement of lubricating properties, emulsification, prevention of adhesion, improvement of photographic properties (for example, acceleration of development, providing hard tones or sensitization), etc.

For example, it is possible to use nonionic surface active agents such as saponin (steroid), alkylene oxide derivatives (for example, polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, polyethylene oxide adducts of silicone, etc.), glycidol derivatives (for example, alkenylsuccinic acid polyglycerides, alkylphenol polyglycerides, etc.), polyhydric alcohol aliphatic acid esters or saccharide alkyl esters, etc.; anionic surface active agents containing acid groups such as a carboxy group, a sulfo group, a phospho group, a sulfate group, a phosphate group, etc., such as alkylcarboxylic acid salts, alkylsulfonic acid salts, alkylbenzenesulfonic acid salts, alkylnaphthalenesulfonic acid salts, alkyl sulfuric acid esters, alkylphosphoric acid esters, N-acyl-N-alkyltaurines, sulfosuccinic acid esters, sulfoalkyl polyoxyethylene alkylphenyl ethers, polyoxyethylene alkylphosphoric acid esters, etc.; ampholytic surface active agents such as amino acids, aminoalkylsulfonic acids, aminoalkylsulfuric acid esters or phosphoric acid esters, alkylbetaines, amine oxides, etc.; and cationic surface active agents such as alkylamine salts, aliphatic or aromatic quaternary ammonium salts, heterocyclic quaternary ammonium salts such as pyridinium salts, imidazolium salts, etc., aliphatic or heterocyclic phosphonium salts, aliphatic or heterocyclic sulfonium salts, etc.

Of the above-described surface active agents, polyethylene glycol type nonionic surface active agents having a recurring unit of ethylene oxide in their molecules are often preferably incorporated into the light-sensitive material. It is particularly preferred that the molecule contains 5 or more of the recurring units of ethylene oxide.

The nonionic surface active agents capable of satisfying the above described conditions are well known as to their structures, properties and methods of synthesis. These nonionic surface active agents are widely used even outside the field of the present invention. Representative references relating to these agents include: *Surfactant Science Series,* Vol. 1, Nonionic Surfactants (edited by Martin J. Schick, Marcel Dekker Inc., 1967), and *Surface Active Ethylene Oxide Adducts,* (edited by Schoufeldt N. Pergamon Press, 1969). Among the nonionic surface active agents described in the above mentioned references, those capable of satisfying the above described conditions are preferably employed in connection with the present invention.

The nonionic surface active agents can be used individually or as a mixture of two or more of them.

The polyethylene glycol type nonionic surface active agents are generally used in an amount of less than 100% by weight, preferably less than 50% by weight, based on hydrophilic binder present.

In the light-sensitive material which is used in the present invention, it is possible to use a compound which activates development simultaneously while stabilizing the image formed. Particularly, it is preferred to use isothiuroniums including 2-hydroxyethylisothiuronium trichloroacetate as described in U.S. Pat. No. 3,301,678, bisisothiuroniums including 1,8-(3,6-dioxaoctane)-bis(isothiuronium trifluoroacetate), etc., as described in U.S. Pat. No. 3,669,670, thiol compounds as described in German Patent Application (OLS) No. 2,162,714, thiazolium compounds such as 2-amino-2-thiazolium trichloroacetate, 2-amino-5-bromoethyl-2-thiazolium trichloroacetate, etc., as described in U.S. Pat. No. 4,012,260, compounds having α-sulfonylacetate as an acid moiety such as bis(2-amino-2-thiazolium)-methylene-bis(sulfonylacetate), 2-amino-2-thiazolium phenylsulfonylacetate, etc., as described in U.S. Pat. No. 4,060,420, and compounds having 2-carboxycarboxamide as an acid moiety as described in U.S. Pat. No. 4,088,496.

When the light-sensitive material is used in the present invention contains a dye providing substance which is particularly represented by a general formula (II), though it is not necessary to further incorporate substances or dyes for preventing irradiation or halation in the light-sensitive material, because the light-sensitive material is colored by the dye providing substance, it is possible to add filter dyes or light absorbing materials, etc., as described in Japanese Patent Publication No. 3692/73 and U.S. Pat. Nos. 3,253,921, 2,527,583 and 2,956,879, etc., in order to further improve sharpness of the image. It is preferred that these dyes have a thermal bleaching property. For example, dyes as described in U.S. Pat. Nos. 3,769,019, 3,745,009 and 3,615,432 are preferred.

The light-sensitive material used in the present invention may contain, if desired or necessary, various additives known for heat developable light-sensitive materials and may have a layer or layers other than the light-sensitive layer, for example, an antistatic layer, an electrically conductive layer, a protective layer, an intermediate layer, an antihalation layer, a strippable layer, etc.

Examples of various additives include those described in *Research Disclosure,* Vol. 170, No. 17029 (June, 1978), for example, plasticizers, dyes for improving sharpness, antihalation dyes, sensitizing dyes, matting agents, surface active agents, fluorescent whitening agents, fading preventing agents, etc.

If necessary, two or more layers may be applied at the same time by the method as described in U.S. Pat. No. 2,761,791 and British Pat. No. 837,095.

In the present invention, the latent image obtained after exposure of the heat-sensitive material can be developed by heating the material at a moderately elevated temperature of, for example, about 80° to about 250° C., for a period of about 0.5 second to about 300 seconds. By increasing or decreasing the heating time, the temperature may be higher or lower within the above range. Temperatures in the range of about 110° to about 160° C. are especially useful. Heating may be carried out by said usual heating means such as a hot plate, an iron, a hot roller, a heat generator using carbon or titanium white, or the like.

Since in the present invention the dye image formed in the heat-sensitive layer of the photographic material is an image which comprises a hydrophilic dye, the image can be transferred to the dye fixing layer in a hydrophilic environment. When this step of dye fixing is carried out in the dry state, it is necessary to transfer the image formed by the mobile hydrophilic dye to the dye fixing layer at high temperatures in the presence of a hydrophilic thermal solvent. The transfer of the mobile dye may start simultaneously with the formation of the dye image or after the formation of the dye image. Accordingly, heating for this transfer may be carried out during or after heat development. Heating during the heat development means that heating for development also acts as heating for the transfer of the formed dye. Since the optimum temperature for development and the optimum temperature for dye transfer and the heating times required for them do not always coincide, it is possible to preset these temperatures independently from each other.

In the present invention, by the term "under a high temperature state under which the hydrophilic thermal solvent exists" is meant the state having an environment temperature higher than 60° C. under which the hydrophilic thermal solvent exists.

Since the heating temperature for the transfer of the dye is 60° C. to 250° C. from the viewpoint of the shelf life, workability, etc., of the light-sensitive materials, substances capable of exhibiting the effects of a hydrophilic thermal solvent in this temperature range can be properly selected. It is as a matter of course necessary that the hydrophilic thermal solvent quickly assists the transfer of dye upon heating, but considering the heat resistance, etc., of light-sensitive materials, the melting point for the hydrophilic thermal solvent is generally 40° C. to 250° C., preferably 40° C. to 200° C., more preferably 40° C. to 150° C.

The term "hydrophilic thermal solvent" in this invention means a compound which is in the solid state at ambient temperature but assumes the liquid state upon heating and in which the inorganic/organisity value is greater than 1 and the solubility in water at ambient temperature is greater than 1. Organisity and inorganisity are parameters for estimating the properties of a compound and details thereon are given in *Kagaku no Ryoiki* (*The Domain of Chemistry*), 11, 719 (1957).

Since the hydrophilic thermal solvent has the role of assisting the transfer of the hydrophilic dye, it is preferred that the thermal solvent be a compound capable of acting as a solvent for the hydrophilic dye.

In general, it is experimentally known that in a solvent preferred for dissolving an organic compound, the inorganisity/organisity value of the solvent is similar to the inorganisity/organisity value of the organic compound. On the other hand, the inorganisity/organisity value of non-diffusible 2-equivalent couplers used in this invention is about 1 and the inorganisity/organisity value of the hydrophilic dye released from the non-diffusible 2-equivalent coupler is larger than 1, preferably larger than 1.5, more preferably larger than 2. It is preferred that the hydrophilic thermal solvent transfer the hydrophilic dye only and not transfer a non-diffusible 2-equivalent coupler; hence, it is necessary that the inorganisity/organisity value of the hydrophilic thermal solvent be larger than the inorganisity/organisity value of the non-diffusible 2-equivalent coupler. In other words, it is a necessary condition that the inorganisity/organisity value of the hydrophilic thermal solvent be larger than 1, preferably larger than 2.

On the other hand, from the viewpoint of the size of a molecule, it is considered to be preferred that molecules capable of transferring without obstructing the transfer of the dye exist around the transferring dye. Accordingly, it is preferred that the molecular weight of the hydrophilic thermal solvent in this invention be small, specifically less than about 200, more preferably less than about 100.

It is sufficient that the hydrophilic thermal solvent used in this invention can substantially assist the transfer of the hydrophilic dye formed by the heat development onto the dye fixing layer. Further, the partial hydrophilic thermal solvent which is required for the transfer of the dye may be incorporated in the light-sensitive layer, or an independent layer containing the hydrophilic thermal solvent may be formed in the dye fixing material having a dye fixing layer. From the viewpoint of increasing the transfer efficiency of the dye onto the dye fixing layer, it is preferred that the hydrophilic thermal solvent be incorporated in the dye fixing layer and/or a layer adjacent the dye fixing layer.

The hydrophilic thermal solvent is usually dispersed in a binder dissolved in water but may also be dispersed while dissolved in an alcohol such as methanol, ethanol, etc.

The coating amount of the hydrophilic thermal solvent used in this invention is generally 5 to 500% by weight, preferably 20 to 200% by weight and more preferably 30 to 150% by weight of the total coating amount of the layers of the light-sensitive material and/or the dye fixing material.

Examples of hydrophilic thermal solvents used in this invention are ureas, pyridines, amides, sulfonamides, imides, alcohols, oximes, and other heterocyclic compounds.

In photographic processing of the light-sensitive material of the present invention, a dye fixing layer (II) is required to which the mobile hydrophilic dye migrates in an imagewise fashion from the light-sensitive layer (I). Layer (II) traps the mobile dye and fixes the dye image upon heat development simultaneously with imagewise exposure or after imagewise exposure.

Generally, light-sensitive layer (I) and the dye fixing layer (I) may be formed on the same support or on different supports. The dye fixing layer (II) may be stripped off from the light-sensitive layer (I), if desired. For example, the photographic material can be imagewise exposed and uniformly heat developed and, thereafter, the dye fixing layer (II) or the light-sensitive layer (I) may be stripped off. When a light-sensitive material having a light-sensitive layer (I) coated on a support and a dye fixing material having a dye fixing layer (II) coated on a support are separately prepared, it is possible to imagewise expose the light-sensitive material, heat it uniformly and superimpose the dye fixing material on it, thereby transferring the mobile dye to the dye fixing layer (II). Alternatively, only light-sensitive layer (I) of the light-sensitive material can be imagewise exposed the dye fixing layer (II), then superimposed on it, and the assembly uniformly heated.

The dye fixing layer (II) may contain a white color reflecting layer. For example, a layer of titanium dioxide dispersed in gelatin may be provided on the mordant layer on a transparent support. The titanium dioxide layer forms a white non-transparent layer, and by viewing the transferred dye image from the side of the transparent support, a reflection color image is obtained.

Intimate contact between the light-sensitive material and the dye fixing material can be effected by conventional methods, for example, by using a press roller. To make the contact sufficient, heating may be done during the contacting.

In photographic processing of the light-sensitive material of the present invention, a dry dye fixing process can be employed where, after heat development after image-wise exposure or simultaneously with imagewise exposure, the light-sensitive material is superposed on the dye fixing material in such a manner that the surface of the light-sensitive material comes into close contact with the dye receiving surface of the dye fixing material and, thereafter, dyes formed are allowed to imagewise migrate to the dye fixing material in a high temperature environment containing a hydrophilic thermal solvent.

The term "high temperature environment containing a hydrophilic thermal solvent" as used herein means an environment in which a hydrophilic thermal solvent(s) is present and the temperature is at least 60° C. In this case, it suffices that the heating to bring the light-sensitive material and dye fixing material to a high temperature condition need only be to a temperature to insure migration of the dyes. For this reason, the temperature and time for this heating can be set independently from that for development. It is preferred, therefore, that the heating for development be controlled so that its contribution to the migration of dyes is suppressed as much as possible but it permits completion for the reaction for development in a short period of time. Similarly, it is preferred that the heating for the migration of dye imagewise formed to the dye fixing material be adjusted to as low a temperature as possible so that undesirable thermal reactions do not occur in unexposed areas, but within a range such that the migration of dyes can be achieved in a suitable time. By controlling the above heat treatment as described above, sharp images can be obtained.

Heating for transfer of the dyes can be effected by using the same heating means as exemplified for the heat development.

One particularly preferred embodiment in the case of using a dry dye fixing step is that the dye fixing layer as a constituent of the dye fixing material of this invention mainly include a dye mordant for dye fixing, a polyvalent metal ion and the hydrophilic thermal solvent for aiding in the movement of the dye and, as further required or desired, contains a base and/or a base precursor for promoting the dye releasing reaction, etc., a development stopping agent and/or an antifoggant for inhibiting image fogging, all of which may be used, if desired, in combination with a binder.

In order to increase the quality of the dye image transferred to the dye fixing layer, it is useful to include the base and/or the base precursor as a dye releasing activator into any of the layers constituting the dye fixing material. It is preferred in this case to include the dye releasing activator in the dye fixing layer or a layer provided above the dye fixing layer, such as a protective layer, because it can give a dye image having sufficient density which is clear and sharp. Examples of the dye releasing activator are the same as those earilier described for the light-sensitive material.

In the case of the light-sensitive material of the present invention, the final image is formed in a dye fixing material which is not sensitive to light. That is, the light-sensitive material and the dye fixing material are provided with different functions, light-sensitivity and fixing of the final image, respectively. Thus, in the preparation of the light-sensitive and dye fixing materials, substances permitting the materials to sufficiently exhibit their own functions can be chosen from among a great variety of compounds.

The amount of bases or their precursors to be used in the dye fixing material can vary over a wide range. It is based on the weight of the dye-fixing layer, most appropriately 50% by weight or less and preferably from 0.01 to 40% by weight. The above bases or their precursors can be used singly or in combination with each other.

The base and/or the base precursor is dissolved in water or an alcohol and then usually dispersed in the dye fixing layer. It may be dispersed by the method described in U.S. Pat. No. 2,322,027 which uses an organic solvent having a high boiling point. Alternatively, it may be dispersed in the dye fixing layer after it is dissolved in an organic solvent having a boiling point of about 30° to about 160° C., for example, a lower alkyl acetate such as ethyl acetate or butyl acetate, ethyl propionate, secondary butyl alcohol, methyl isobutyl ketone, β-ethoxyethyl acetate, methyl cellosolve acetate, and cyclohexane.

Examples of high-boiling organic solvents that can be used include alkyl phthalates such as dibutyl phthalate and dioctyl phthalate, phosphates such as diphenyl phosphate, triphenyl phosphate, tricresyl phosphate and dioctyl butyl phosphate, citrates such as tributyl acetylcitrate, benzoates such as octyl benzoate, alkylamides such as diethyllaurylamide, fatty acid esters such as dibutoxyethyl succinate and dioctyl azelate, and trimesates such as tributyl trimesate. The above high-boiling organic solvents may be used as a mixture with low-boiling organic solvents. Dispersing methods using polymers as described in Japanese Patent Publication No. 39853/76 and Japanese Patent Application (OPI) No. 59943/76 may also be used.

The dye fixing layer in accordance with this invention consists of one or a plurality of layers and contains a dye mordant for dye fixing. The base and/or the base precursor is generally used dispersed in the layer containing the dye mordant. In another form, the base and/or the base precursor can be used dispersed in a binder in a layer adjacent the layer containing the dye mordant.

As dye mordants, various mordants can be used. Particularly useful ones are polymers represented by the following general formula (IV):

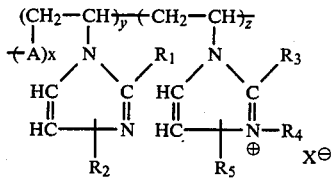

(IV)

where:

A is a vinyl monomer unit which does not contain an imidazole or imidazolium group;

$R_1$ and $R_3$ are each a hydrogen atom, an alkyl group, or an alkyl group substituted by a group capable of forming a coordination bond with metals, or a salt thereof;

$R_2$ and $R_5$ are each a hydrogen atom, an alkyl group, an aralkyl group, or an aryl group;

$R_4$ is an alkyl group, or an aralkyl group;

$X^-$ is an acid radical;

x is from 0 to 80 mol%;

y is from 10 to 100 mol%; and z is from 0 to 50 mol%.

The above mordants are hardened when metal ions are present, thereby increasing the transferability of images to the dye fixing material and the fastness in dark place of the dye images formed. For this reason, it is preferred that the dye fixing material of the present invention have a layer containing metal ions. Preferred examples of such metal ions are $Zn^{2+}$, $Ni^{2+}$, $Mn^{2+}$, $Al^{3+}$ and $Co^{3+}$. Particularly preferred is $Zn^{2+}$.

The dye fixing layer of the present invention may contain a polyvalent metal ion or a metal ion providing substance in order to fix the dye capable of being subjected to a chelation.

The metal ion providing substance is described in Japanese Patent Publication No. 77535/61 and Japanese Patent Application (OPI) Nos. 48210/80 and 129346/80.

In the present invention, a polyvalent metal ion which rapidly reacts with a dye released and consequently, firmly links to the ligands to form a complex having a desired hue and which is substantially colorless in the dye fixing layer, is the most effective. The examples of polyvalent metal ions include copper (II), nickel (II), palladium (II), zinc (II), platinum (II) and cobalt (II), etc.

Thus, per the present invention, the dye fixing layer can contain a dye mordant in order to fix the dye. Various mordants can be used, and polymer mordants are particularly preferred. In addition to the mordant(s), the dye fixing layer may contain the base(s), base precursor(s) and thermal solvent(s). In particular, it is particularly preferred to incorporate the base(s) or base precursor(s) into the dye fixing layer in the case where the light-sensitive layer and the dye fixing layer are formed on different supports.

Polymer mordants used in the present invention are typically polymers containing secondary and tertiary amino groups, polymers containing nitrogen-containing heterocyclic moieties, polymers having quaternary cationic groups, etc. They typically have a molecular weight of from 5,000 to 200,000, better yet from 10,000 to 50,000.

For example, there can be illustrated vinylpyridine polymers and vinylpyridinium cationic polymers are disclosed in U.S. Pat. Nos. 2,548,564, 2,484,430, 3,148,061 and 3,756,814, etc., polymer mordants capable of cross-linking with gelatin as disclosed in U.S. Pat. Nos. 3,625,694, 3,859,096, and 4,128,538 and British Pat. No. 1,277,453, etc., aqueous sol type mordants as disclosed in U.S. Pat. Nos. 3,958,995, 2,721,852 and 2,798,063 and in Japanese Patent Application (OPI) Nos. 115228/79, 145529/79 and 126027/79, etc., water-insoluble mordants as disclosed in U.S. Pat. No. 3,898,088, etc., reactive mordants capable of forming covalent bonds with dyes used as disclosed in U.S. Pat. No. 4,168,976 (Japanese Patent Application (OPI) No. 137333/79), etc., and mordants as disclosed in U.S. Pat. Nos. 3,709,690, 3,788,855, 3,642,482, 3,488,706, 3,557,066, 3,271,147 and 3,271,148, Japanese Patent Application (OPI) Nos. 71332/75, 30328/78, 155528/77, 125/78 and 1024/78, etc.

In addition, mordants as disclosed in U.S. Pat. Nos. 2,675,316 and 2,882,156 can be used.

Of these mordants, for example, mordants capable of cross-linking with a matrix such as gelatin, water-insoluble mordants, and aqueous sol (or latex dispersion) type mordants are preferably used.

Particularly preferable polymer mordants are described below.

(1) Polymers having quaternary ammonium groups and groups capable of forming covalent bonds with gelatin (for example, aldehydo groups, chloroalkanoyl groups, chloroalkyl groups, vinylsulfonyl groups, pyridiniumpropionyl groups, vinylcarbonyl groups, alkylsulfonoxy groups, etc., such as

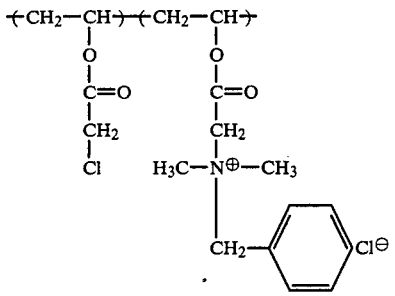

(2) Reaction products between a copolymer comprising a repeating unit of a monomer represented by the general formula described below with a repeating unit of another ethylenically unsaturated monomer and a cross-linking agent (for example, bisalkanesulfonate, bisarenesulfonate, etc.):

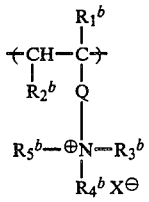

wherein $R_1^b$ represents H or an alkyl group, $R_2^b$ represents H, an alkyl group or an aryl group, Q represents a divalent group, $R_3^b$, $R_4^b$ and $R_5^b$ each represents an alkyl group, an aryl group or at least two of $R_3^b$ to $R_5^b$ are bonded to gether to form a hetero ring, and X represents an anion. The above described alkyl groups and aryl groups may be substituted.

(3) Polymers represented by the following general formula:

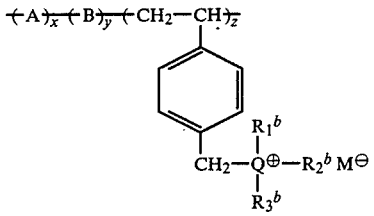

wherein x is from about 0.25 mol% to about 5 mol%, y is from about 0 mol% to about 90 mol%, z is from about 10 mol% to about 99 mol%, A represents a monomer having at least two ethylenically unsaturated bonds, B represents a copolymerizable ethylenically unsaturated monomer, Q represents N or P, $R_1^b$, $R_2^b$ and $R_3^b$ each represents an alkyl group or a cyclic hydrocarbon group or at least two of $R_1^b$ to $R_3^b$ are bonded together to form a ring (these groups and rings may be substituted), and M represents an anion.

(4) Copolymers composed of (a), (b) and (c), wherein (a) is

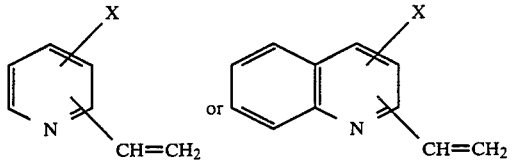

wherein X represents a hydrogen atom, an alkyl group or a halogen atom (the alkyl group may be substituted);

(b) is an acrylic ester; and (c) is acrylonitrile.

(5) Water-insoluble polymers wherein at least $\frac{1}{3}$ of the repeating units are those represented by the following general formula

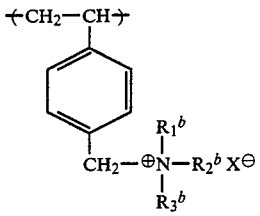

wherein $R_1^b$, $R_2^b$ and $R_3^b$ each represents an alkyl group, with the total number of carbon atoms included being 12 or more (the alkyl group may be substituted), and X represents an anion.

Various kinds of known gelatins can be employed as the gelatin for the mordant layer. For example, gelatin which is produced in different manners such as lime-processed gelatin, acid-processed gelatin, etc., or a gelatin derivative which is prepared by chemically modifying gelatin such as phthalated gelatin, sulfonylated gelatin, etc., can be used. Also, gelatin subjected to a desalting treatment can be used, if desired.

The ratio of polymer mordant to gelatin and the amount of the polymer mordant coated can be easily determined by one skilled in the art depending on the amount of the dye to be mordanted, the type and composition of the polymer mordant and further on the image-forming process used. Preferably, the ratio of mordant to gelatin is from 20/80 to 80/20 (by weight) and the amount of the mordant coated is from 0.5 to 8 $g/m^2$.

The polymer mordants and bases and/or their precursors can be dispersed in the following hydrophilic binders. These binders can be used singly or in combination with each other. Typical examples of hydrophilic binders are transparent or translucent hydrophilic colloids, including natural products such as proteins (e.g., gelatin, gelatin derivatives, and cellulose derivatives) and polysaccharides (e.g., starch, gum arabic, dextrin, and pullulan), and synthetic polymers such as water-soluble vinyl compounds (e.g., polyvinyl alcohol, polyvinyl pyrrolidone, and polyacrylamide). Other synthetic polymeric compounds are vinyl polymer dispersions which are used to increase the dimensional stability of photographic materials.

For the transfer of the dye from the light-sensitive layer to the dye fixing layer, a dye transfer aid may be used. Water or a basic aqueous solution containing sodium hydroxide, potassium hydroxide, or an inorganic alkali metal salt may be used. A low boiling solvent such as methanol, N,N-dimethylformamide, acetone or diisobutyl ketone or a mixture of the low boiling solvent and water or a basic aqueous solution may also be used. The dye transfer aid may be used by wetting the image-receiving layer with it, or it may be included in the material as water of crystallization or in microcapsules.

When the dye fixing layer is located on the surface of the dye fixing material, a protective layer may, as required, be further formed on it. Protective layers generally used in light-sensitive materials may be used as such a protective layer. When the dye fixing layer is provided in the dye fixing material separately from the light-sensitive material, it is preferred to impart hydrophilicity to the protective layer in order to not inhibit the transfer of the hydrophilic dye.

Heating for transfer of the dyes can be effected by using the same heating means as exemplified for the heat development.

In order to increase the quality of the dye image transferred to the dye fixing layer, it is preferred to prevent an increase in fogging by the occurrence of unnecessary development during dye transfer. For this purpose, it is especially effective to include a compound which reacts with the silver halide and/or can have the silver halide adsorbed thereon as a development stopping agent and/or an antifoggant in any one of the layers constituting the dye fixing material. Such a compound is preferably included in the dye fixing layer or a layer provided above the dye fixing layer, such as a protective layer, because it rapidly inhibits excessive development of the light-sensitive layer during transfer of the dye by heating and a sharp and clear dye image can be obtained. Such compounds include, for example, a nitrogen-containing heterocyclic compound, preferably a 5- or 6-membered heterocyclic compound containing a nitrogen atom.

The support for the dye fixing material may be selected from those supports described above which are used in the light-sensitive materials. Preferably, the support is a polymeric material which is resistant to the heating effected for development or dye transfer.

Examples of organic polymeric materials used in the dye fixing material of this invention include polystyrene having a molecular weight of 2,000 to 85,000, polystyrene derivatives having substituents with not more than 4 carbon atoms, polyvinyl cyclohexane, polydivinylbenzene, polyvinylpyrrolidine, polyvinylcarbazole, polyallylbenzene, polyvinyl alcohol, polyacetals such as polyvinyl formal and polyvinyl butyral, polyvinyl chloride, chlorinated polyethylene, polytrifluoroethylene, polyacrylonitrile, poly-N,N-dimethylallylamide, polyacrylates having a p-cyanophenyl group, a pentachlorophenyl group or a 2,4-dichlorophenyl group, polyacrylchloroacrylate, polymethyl methacrylate, polyethyl methacrylate, polypropyl methacrylate, polyisopropyl methacrylate, polyisobutyl methacrylate, polytertiary butyl methacrylate, polycyclohexyl methacrylate, polyethylene glycol dimethacrylate, poly-2-cyanoethyl methacrylate, polyesters such as polyethylene terephthalate, polysulfone, bisphenol A polycarbonate, polycarbonates, polyanhydrides, polyamides and cellulose acetate. The synthetic polymers described in "Polymer Handbook", 2nd edition (edited by J. Brandrup and E. H. Immergut, published by John Wiley and Sons, Inc.) are also useful. These polymeric substances may be used singly or a plurality of them may be used in the form of a copolymer.

Especially useful supports are films of cellulose acetate films such as cellulose triacetate or diacetate, films of polyamides derived from a combination of heptamethylenediamine and terephthalic acid, a combination of fluorenedipropylamine and adipic acid, a combination of hexamethylenediamine and diphenic acid, and a combination of hexamethylenediamine and isophthalic acid, films of polyesters derived from a combination of diethylene glycol and diphenylcarboxylic acid and a combination of bis-p-carboxyphenoxybutane and ethylene glycol, a polyethylene terephthalate film and a polycarbonate film. These films may be modified. For example, polyethylene terephthalate films modified by such modifiers as cyclohexane dimethanol, isophthalic acid, methoxypolyethylene glycol or 1,2-dicarbomethoxy-4-benzenesulfonic acid are effective.

In the photographic light-sensitive material and the dye fixing material of the present invention, the photographic emulsion layer and other binder layers may contain inorganic or organic hardeners. It is possible to use chromium salts (chromium alum, chromium acetate, etc.), aldehydes (formaldehyde, glyoxal, glutaraldehyde, etc.), N-methylol compounds (dimethylolurea, methylol dimethylhydantoin, etc.), dioxane derivatives (2,3-dihydroxydioxane, etc.), active vinyl compounds (1,3,5-triacryloylhexahydro-s-triazine, 1,3-vinylsulfonyl-2-propanol, etc.), active halogen compounds (2,4-dichloro-6-hydroxy-s-triazine, etc.), mucohalogenic acids (mucochloric acid, mucophenoxychloric acid, etc.), etc., which are used individually or as a combination thereof.

EXAMPLE 1

Preparation of Silver Iodobromide Emulsion

A mixture of 40 g of gelatin and 26 g of KBr was dissolved in 3,000 ml of water, and the resulting solution was stirred while maintaining it at 50° C. A solution of 34 g of silver nitrate in 200 ml of water was added over 10 minutes, and then a solution of 3.3 g of KI in 100 ml of water was added over 2 minutes.

The thus-prepared silver iodobromide emulsion was precipitated by controlling its pH and freed of excess salts and, thereafter, it was adjusted to pH 6.0 to thereby yield a silver iodobromide emulsion (yield, 400 g).

Preparation of Silver Benzotriazole Emulsion

A mixture of 28 g of gelatin and 13.2 g of benzotriazole was dissolved in 3,000 ml of water, and the resulting solution was stirred while maintaining it at 40° C. A solution of 17 g of silver nitrate in 100 ml of water was added over 2 minutes, and the resulting emulsion was precipitated and freed of excess salts by controlling its pH. Then the emulsion was adjusted to pH 6.0 to thereby yield benzotriazole (yield, 400 g).

Preparation of Dispersion of Dye-Providing Substance in Gelatin

A mixture of 5 g of a magenta dye-providing substance (CC), 0.5 g of sodium succinic acid-2-ethyl-hexylester sulfonate, and 5 g of tricresyl phosphate (TCP) was dissolved in 30 ml of ethyl acetate by heating at about 60° C. to thereby prepare a uniform solution. This solution and 100 g of a 10% solution of lime-treated gelatin were mixed and stirred and, thereafter, dispersed by the use of a homogenizer at 10,000 rpm for 10 minutes. This dispersion is called a "dispersion of the dye providing substance (CC)".

Dye providing substance (CC)

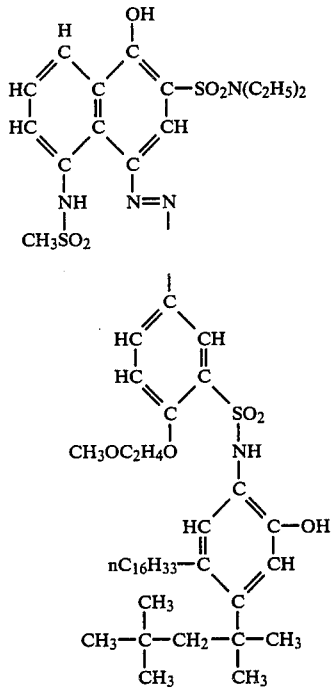

Preparation of Light-Sensitive Material A

| | | |
|---|---|---|
| (a) | Silver iodobromide emulsion prepared above | 25 g |
| (b) | Dispersion of dye providing substance (CC) | 33 g |
| (c) | 5% Aqueous solution of Compound AA | 5 ml |
| (d) | 10% Ethanol solution of guanidine-trichloroacetic acid | 12 ml |
| (e) | 10% Aqueous solution of the compound having the following formula: | 4 ml |

-continued

| |
|---|
| $H_2N—SO_2—N(CH_3)_2$ |

The above ingredients were mixed to prepare a solution. This solution was coated on a polyethylene terephthalate film at a wet thickness of 30 μm and then dried.

| | | |
|---|---|---|
| (f) | 10% Aqueous solution of lime-processed gelatin | 35 g |
| (g) | 10% Ethanol solution of guanidine-trichloroacetic acid | 6 ml |
| (h) | 1% Aqueous solution of sodium succinic acid-2-ethyl-hexylester sulfonate | 4 ml |
| (i) | Water | 55 ml |
| (j) | 1% Aqueous solution of polyacrylic acid amide | 4 ml |

A solution consisting of the above ingredients (f) to (j) was formed by mixing the same together and was coated on the above-prepared layer to a wet thickness of 25 μm as a protective layer to thereby produce light-sensitive material A.

Preparation of Dye-Fixing Material

A1:1 mixture of polyacrylic acid (degree of polymerization: 2,000) and polyvinyl alcohol was coated on a polyethylene terephthalate support (with titanium dioxide coated thereon) in an amount of 2 g/m$^2$ to prepared a layer. A uniform mixture of 100 g of a 10% aqueous solution of a methyl acrylate/N,N,N-trimethyl-N-vinylbenzylammonium chloride (1:1) copolymer, 120 g of 10% polyvinyl alcohol (degree of saponification: 98%; degree of polymerization: 2,000), 10 g of urea, and 26 g of N-methylurea was coated on the above prepared layer to a wet thickness of 70 μm and then dried to produce a dye fixing material.

Light-sensitive material A was imagewise exposed to light for 10 seconds by the use of a 2,000 lux tungsten lamp and, thereafter, uniformly heated on a heat block maintained at 140° C. for 20 seconds.

The light-sensitive material heated as above was superposed on the dye fixing material in such a manner that both the top layers were in contact with each other and the assembly was passed through a pair of heated rollers maintained at 120° C. and heated under pressure for 40 seconds. Then, the dye fixing material was separated from the light-sensitive material. They could be readily separated from each other and a positive magenta image relative to the silver image was formed on the dye fixing material.

EXAMPLE 2

Light-sensitive material B was prepared in the same manner as light-sensitive material A except that in the preparation of the protective layer, 4 ml of a 1% aqueous solution of methacrylamide was used in place of 4 ml of the 1% aqueous solution of polyacrylic acid amide. In addition, light-sensitive material C was prepared in the same manner as light-sensitive material A except that in the preparation of the protective layer, 10 ml of a 10% aqueous solution of polyvinyl alcohol (degree of polymerization: 2,000) was used in place of 4 ml of the 1% aqueous solution of polyacrylic acid amide.

For comparison, light-sensitive material D was prepared also in the same manner as light-sensitive material A except that in the preparation of the protective layer, 4 ml of a 2% aqueous soluton of potassium polyvinylbenzene sulfonate was used in place of 4 ml of the 1% aqueous solution of polyacrylic acid amide.

Light-sensitive materials B to D were tested for separation and image-forming characteristics. In the case of light-sensitive material D, the emulsion layer of the light-sensitive material stuck to the dye fixing material and good image could not be obtained. On the other hand, in light-sensitive materials B and C, the light-sensitive material could be readily separated from the dye fixing material and good images were obtained.

This demonstrates that the light-sensitive material of the present invention can be readily separated from the dye fixing material; that is, its separation characteristics are superior.

EXAMPLE 3

Preparation of Light-Sensitive Material E

Light-sensitive material E was prepared in the same manner as light-sensitive material A except that in the preparation of the light-sensitive layer a dye providing substance (cx) which was shown by a following formula was used in place of the dye providing substance (cc). Dispersion of the dye providing substance (cx) was prepared in the same manner as dispersion of the dye providing substance (cc) except that the dye providing substance (cx) was used in place of the dye providing substance (cc).

Dye Providing Substance (cx)

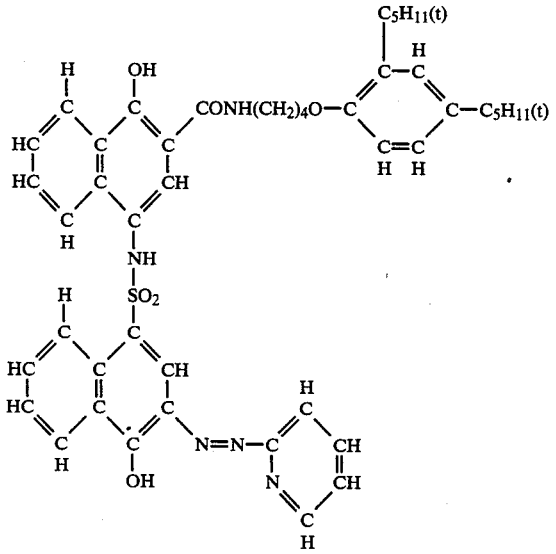

Preparation of Dye Fixing Material

A 1:1 mixture of polyacrylic acid (degree of polymerization: 2,000) and polyvinyl alcohol was coated on a polyethylene terephthalate support (with titanium dioxide coated thereon) in an amount of 2 g/m$^2$ and then nickel sulfate was coated thereon in an amount of 0.5 g/m$^2$ to prepare a layer. A uniform mixture of 100 g of a 10% aqueous solution of a polyvinyl imidazole, 120 g of 10% polyvinyl alcohol (degree of saponification: 98%; degree of polymerization: 2,000), 10 g of urea, and 26 g of N-methylurea was coated on the above-prepared layer to a wet thickness of 70 μm and then dried to produce a dye fixing material.

Light-sensitive material E was imagewise exposed to light for 10 seconds by the use of a 2,000 lux tungsten lamp and, thereafter, uniformly heated on a heat block maintained at 140° C. for 20 seconds.

The light-sensitive material heated as above was superposed on the dye fixing material in such a manner that both the top layers were in contact with each other and the assembly was passed through a pair of heated rollers maintained at 120° C. and heated under pressure for 40 seconds. Then, the dye fixing material was separated from the light-sensitive material. They could be readily separated from each other and a positive magenta image relative to the silver image was formed on the dye fixing material.

EXAMPLE 4

Light-sensitive material F was prepared in the same manner as light-sensitive material A except that in the preparation of the protective layer, 4 ml of a 1% aqueous solution of methacrylamide was used in place of 4 ml of the 1% aqueous solution of polyacrylic acid amide. In addition, light-sensitive material G was prepared in the same manner as light-sensitive material A except that in the preparation of the protective layer, 10 ml of a 10% aqueous solution of polyvinyl alcohol (degree of polymerization: 2,000) was used in place of 4 ml of the 1% aqueous solution of polyacrylic acid amide.

For comparison, ligt-sensitive material H was prepared also in the same manner as light-sensitive material A except that in the preparation of the protective layer, 4 ml of a 2% aqueous solution of potassium polyvinylbenzene sulfonate was used in place of 4 ml of the 1% aqueous solution of polyacrylic acid amide.

Light-sensitive materials F to H were tested for separation and image-forming characteristics. In the case of light-sensitive material H, the emulsion layer of the light-sensitive material stuck to the dye fixing material and good images could not be obtained. On the other hand, in light-sensitive materials F and G, the light-sensitive material could be readily separated from the dye fixing material and good images were obtained.

This demonstrates that the light-sensitive material of the present invention can be readily separated from the dye fixing material; that is, its separation characteristics are superior.

EXAMPLE 5

Light-sensitive materials E, F, G and H which were prepared in Examples 3 and 4 were used.

A method for preparing a dye fixing material containing image receiving layers is hereinafter described.

A uniform mixture of 0.75 g of gelatin hardening agent H-1, 0.25 g of gelatin hardening agent H-2 which are respectively shown by following formulae, 2.5 g of nickel sulfate, 160 ml of distilled water and 100 g of 10% (aqueous solution) of acid-processed gelatin was uniformly coated on a paper support laminated thereon by titanium oxide dispersed polyethylene in a wet thickness of 60 μm and then dried.

Gelatin Hardening Agent H-1

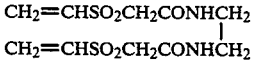

Gelatin Hardening Agent H-2

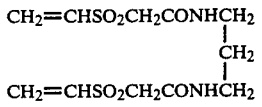

A uniform mixture of 10 g of a polymer which is shown by a following formula, 200 ml of distilled water and 100 g of 10% aqueous solution of lime-processed gelatin was uniformly coated on the above-described coating substance. The coated sample was dried and used as a dye fixing material.

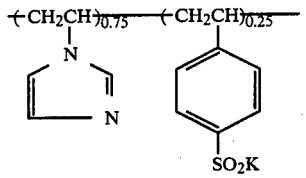

wherein $[\eta]$ g/dl=0.4 which was measured in the mixed solvent of 0.2 mol/l of disodium phosphate aqueous solution and acetonitrile (volume ratio=8:2) at 30° C.

Light-sensitive materials F to H were imagewise exposed to light for 10 seconds by the use of a 2,000 lux tungsten lamp and, thereafter, uniformly heated on a heat block maintained at 140° C. for 20 seconds. The light-sensitive materials heated were superposed on the dye fixing material on which 5 g/m$^2$ of water was uniformly coated. In addition, the assembly was passed through a pair of rollers under pressure and then through heating part and the image was transferred in 5 seconds. In this case, the temperature of the assembly during being passed through the heating part was maintained at 90° C. When the dye fixing material was separated from the light-sensitive material, a positive magenta image relative to the silver image was formed on the dye-fixing material.

Light-sensitive materials E to H were tested for separation and image-forming characteristics. In the case of light-sensitive material H, the emulsion layer of the light-sensitive material stuck to the dye fixing material and good images could not be obtained. On the other hand, in light-sensitive materials E, F and G, the light-sensitive material could be readily separated from the dye fixing material without the emulsion layer of the light-sensitive material sticking to the dye fixing material and good images were obtained.

This demonstrates that the light-sensitive material of the present invention can be readily separated from the dye fixing material; that is, its separation characteristics are superior.

While the invention has been described in detail and with reference to specific embodiments thereof, it will be apparent to one skilled in the art that various changes and modifications can be made therein without departing from the spirit and scope thereof.

What is claimed is:

1. A dye image forming process, comprising:

heat developing a heat developable light-sensitive silver halide, a hydrophilic binder and a dye providing substance by heating after imagewise exposure or simultaneously with imagewise exposure to imagewise form a mobile dye, transferring said mobile dye from said heat developable light-sensitive material to a dye fixing material comprising a support having thereon a dye fixing layer, a hydrophilic binder and a mordant by heating after the heat developing or simultaneously with the heat developing in the presence of a hydrophilic thermal solvent which is contained in the dye fixing layer or a layer adjacent thereto and is coated in an amount of 20–200% by weight based on the total coating amount of the layers of the heat developable light-sensitive material and the dye fixing material, and peeling said dye fixing material form said heat developable light-sensitive material, said heat-developable light-sensitive material further comprising a protective layer on the side that said heat developable light-sensitive material contacts with said dye fixing material containing gelatin and at least one nonionic hydrophilic polymer having a molecular weight range of 2,000 to 1,000,000 which is selected from the following group (i) or (ii):

(i) a nonionic hydrophilic polymer represented by the general formula (I):

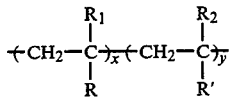

(I)

wherein x is 0 to 100 mol%, y is 0 to 100 mol%, the total of x and y is 100 mol%, $R_1$ is hydrogen or alkyl, $R_2$ is hydrogen or alkyl, R is —OH, carbamoyl or a 5- or 6-membered nitrogen-containing heterocyclic group and R′ is —OH, carbamoyl or a 5- or 6-membered nitrogen-containing heterocyclic group; or (ii) a nonionic hydrophilic polymer selected from the group consisting of:

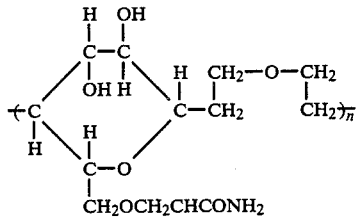

wherein n represents the degree of polymerization, dextran, graft polymers of dextrin and ethylene oxide, graft polymers of dextrin and propylene oxide, poly(N-vinyl)pyrrolidone, grafted gelatin, hydroxyethyl cellulose, hydroxypropylmethyl cellulose phthalate, a polymer having the following repeating unit:

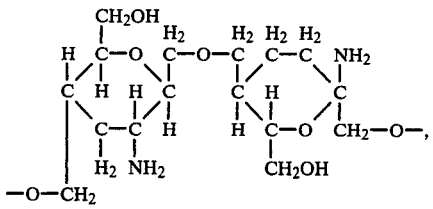

starch, or pullulan.

2. The dye image forming process as claimed in claim 1, wherein the dye providing substance is represented by the general formula (II):

$$D-Y \qquad (II)$$

wherein D represents a dye moiety or a precursor thereof, and Y represents a substrate having the function of changing the diffusibility of the dye providing substance (II) by an oxidation-reduction reaction in the heat development process.

3. The dye image forming process as claimed in claim 1, wherein the dye providing substance, hydrophilic binder and light-sensitive silver halide of the heat developable light-sensitive material are contained in the same layer.

4. The dye image forming process as claimed in claim 1, wherein nonionic hydrophilic polymer represented by the general formula (I) is selected from the group consisting of:

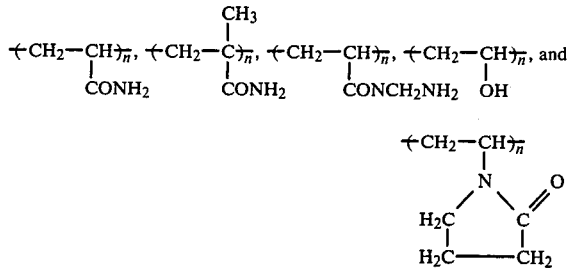

wherein n represents the degree of polymerization.

5. The dye image providing process as claimed in claim 1, wherein the dye fixing material and the heat developable light-sensitive material contain separate supports.

6. The dye image providing process as claimed in claim 1, wherein the heating temperature for the transfer of the dye is 60° C. to 250° C.

7. The dye image providing process as claimed in claim 1, wherein said nonionic hydrophilic polymer selected from the group (i) or (ii) has a molecular weight range of 5,000 to 400,000.

8. The dye image providing process as claimed in claim 1, wherein said protective layer contains 0.01 to 5 $g/m^2$ of said nonionic hydrophilic polymer selected from the group (i) or (ii).

9. The dye image providing process as claimed in claim 1, wherein said protective layer contains 0.1 to 2 $g/m^2$ of said nonionic hydrophilic polymer selected from the group (i) or (ii).

10. The dye image providing process as claimed in claim 3, comprising sequentially heating the imagewise exposed heat developable light-sensitive material, putting a dye fixing material thereon and peeling the dye fixing material from said heat developable light-sensitive material.

* * * * *